US007631775B2

(12) United States Patent
Heisner et al.

(10) Patent No.: US 7,631,775 B2
(45) Date of Patent: Dec. 15, 2009

(54) PLASTIC CONTAINER HAVING GRIPPING PORTIONS

(75) Inventors: David B. Heisner, York, PA (US); Jamie Degroff, York, PA (US); Philip Sheets, York, PA (US)

(73) Assignee: Graham Packaging Company, L.P., York, PA (US)

( * ) Notice: Subject to any disclaimer, the term of this patent is extended or adjusted under 35 U.S.C. 154(b) by 316 days.

(21) Appl. No.: 11/411,914

(22) Filed: Apr. 27, 2006

(65) Prior Publication Data

US 2007/0210028 A1 Sep. 13, 2007

Related U.S. Application Data

(60) Provisional application No. 60/780,826, filed on Mar. 10, 2006.

(51) Int. Cl.
*B65D 23/10* (2006.01)

(52) U.S. Cl. ..... 215/381; 215/384; 215/398; 220/771

(58) Field of Classification Search ..... 215/383, 215/384, 398, 381; D9/538, 530, 533, 541; 220/771
See application file for complete search history.

(56) References Cited

U.S. PATENT DOCUMENTS 3,537,498 A * 11/1970 St. Amand ..... 604/403
D279,167 S * 6/1985 Haney et al. ..... D9/540
D294,120 S * 2/1988 Griesing et al. ..... D9/520
D379,763 S * 6/1997 Ewing, Jr. ..... D9/520
D411,803 S * 7/1999 Guertin ..... D9/520
5,971,184 A * 10/1999 Krishnakumar et al. ..... 215/384
6,161,713 A * 12/2000 Krich ..... 215/384
6,575,321 B2 * 6/2003 Bourque et al. ..... 215/384
D487,228 S * 3/2004 Heisner et al. ..... D9/538
6,830,158 B2 * 12/2004 Yourist ..... 215/381
6,974,047 B2 * 12/2005 Kelley et al. ..... 215/381
D522,371 S * 6/2006 Livingston ..... D9/538
D525,527 S * 7/2006 Ogg ..... D9/516
2005/0092708 A1 * 5/2005 Heisner et al. ..... 215/384
2007/0170144 A1 * 7/2007 Lane et al. ..... 215/383

* cited by examiner

*Primary Examiner*—Sue A Weaver
(74) *Attorney, Agent, or Firm*—Knoble Yoshida & Dunleavy, LLC

(57) ABSTRACT

A plastic container comprises a sidewall including an upper end and a lower end, a base connected to the lower end of the sidewall, a dome connected to the upper end of the sidewall, the dome including a finish portion adapted to receive a closure, first and second primary grip panels recessed into the dome, first and second secondary grip panels recessed into the dome, and a plurality of support columns located on the dome, with a support column located between each adjacent pair of primary and secondary grip panels.

19 Claims, 6 Drawing Sheets

PLASTIC CONTAINER HAVING GRIPPING PORTIONS

CROSS-REFERENCE TO RELATED APPLICATIONS

The present application claims priority of U.S. Provisional Application No. 60/780,826, filed on Mar. 10, 2006, the entire contents of which are incorporated herein by reference.

BACKGROUND OF THE INVENTION

1. Field of the Invention

The present invention relates generally to plastic containers, and more particularly, to plastic containers including grip features.

2. Related Art

Containers, and particularly plastic containers, are subjected to varying forces during filling, sealing, and storage. For example, hot-filled containers often experience internal forces, such as vacuum forces, that occur as a result of shrinkage of the container's contents as they cool. In addition, plastic containers are often subject to considerable top loads during storage and transportation, for example, as a result of stacking several layers of containers on top of one another. Containers typically include reinforcing structures to accommodate these forces, including various ribs, panels, waists, and combinations of these structures. Many of the known structures, however, detract from the appearance and/or ergonomics of the container. Therefore, there remains a need in the art for a plastic container that overcomes the shortcomings of conventional designs.

BRIEF SUMMARY OF THE INVENTION

The present invention provides a plastic container including a unique, multifunctional grip component that provides an area for branding or other aesthetic enhancement, and also increases the top load strength of the container.

According to one exemplary embodiment, the plastic container comprises a sidewall including an upper end and a lower end, a base connected to the lower end of the sidewall, a dome connected to the upper end of the sidewall, the dome including a finish portion adapted to receive a closure, first and second primary grip panels recessed into the dome, first and second secondary grip panels recessed into the dome, and a plurality of support columns located on the dome, with a support column located between each adjacent pair of primary and secondary grip panels.

According to another exemplary embodiment, the plastic container comprises a sidewall comprising four sidewall portions and four corner portions defining a substantially rectangular cross-section, the sidewall including an upper end and a lower end, a base connected to the lower end of the sidewall, a dome connected to the upper end of the sidewall, the dome including a finish portion adapted to receive a closure, first and second substantially opposed grip panels recessed into the dome, third and fourth substantially opposed grip panels recessed into the dome, and a plurality of support columns located on the dome, with a support column located between each adjacent pair of grip panels.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without departing from the spirit and scope of the invention. All references cited herein are incorporated by reference as if each had been individually incorporated.

Referring to FIGS. 1-6, an exemplary embodiment of a plastic container 10 according to the present invention is shown. The container 10 can be used to package a wide variety of liquid, viscous, or solid products including, for example, juices, other beverages, yogurt, sauces, pudding, lotions, soaps in liquid or gel form, and bead shaped objects such as candy. The container 10 generally includes a sidewall 12 including an upper end 12*a* and a lower end 12*b*, a base 14 connected to the lower end 12*b*, and a dome 16 connected to the upper end 12*a*.

Figure 5:
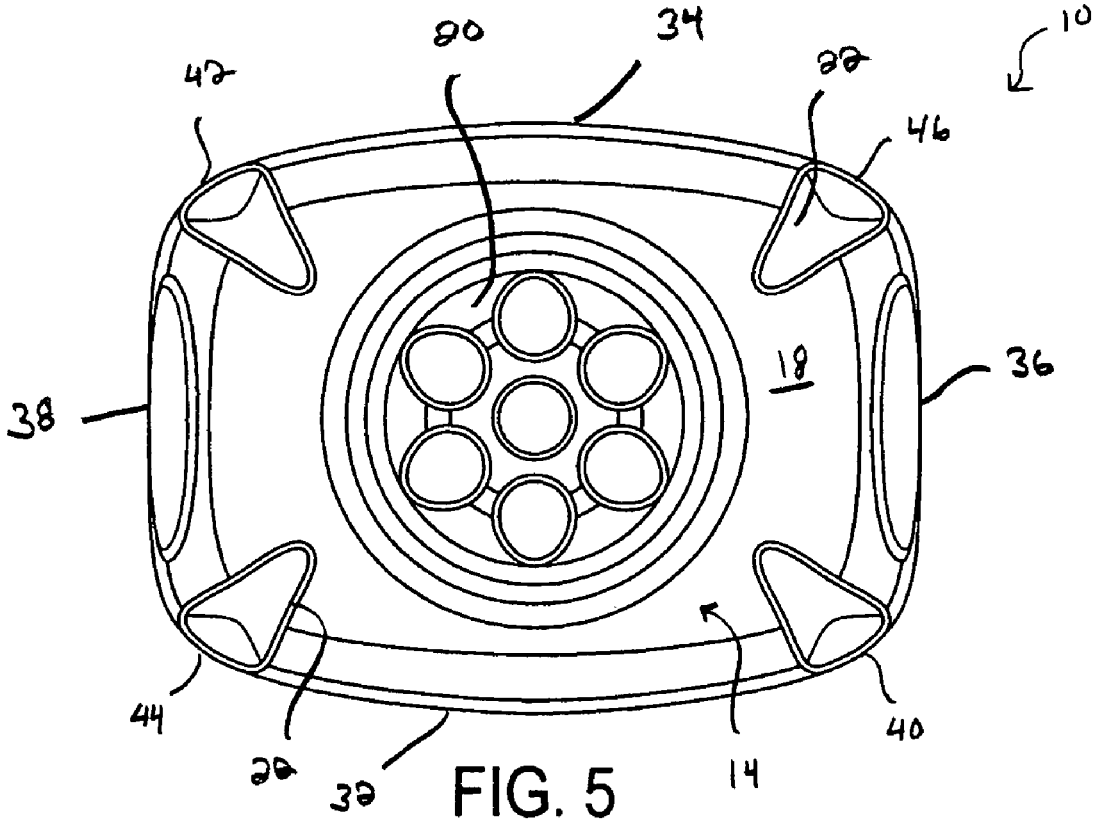
FIG. 5 is a bottom view of the container of FIG. 1.

Referring to FIG. 5, the base 14 can comprise a substantially flat standing surface 18 adapted to support the container 10 in an upright position on a table or other surface. The base 14 can also include a push-up 20 or other concave reinforcement structure. The push-up 20 can be adapted to reinforce the base 14 and/or container 10. Alternatively, the push-up 20 and/or standing surface 18 can account for internal forces (e.g., vacuum forces) developed within the container 10 during filling and capping (e.g., during hot-filling). For example, the standing surface 18 can flex slightly inward to accommodate vacuum. The base 14 can also include ribs 22 that extend into the lower end 12*b* of the sidewall and reinforce the corners of the base 14 and/or sidewall 12.

Referring to FIGS. 1-4, the dome 16 can comprise a substantially convex surface that gradually tapers inward from the upper end 12*a* of the sidewall 12, to a finish portion 24, however, other shapes and configurations are possible. The finish portion 24 defines an opening into the container 10 through which the contents can be dispensed. Threads 26, or other attachment features known in the art, can be provided on the finish portion 24 in order to secure a closure (not shown) onto the finish portion 24.

Figure 1:
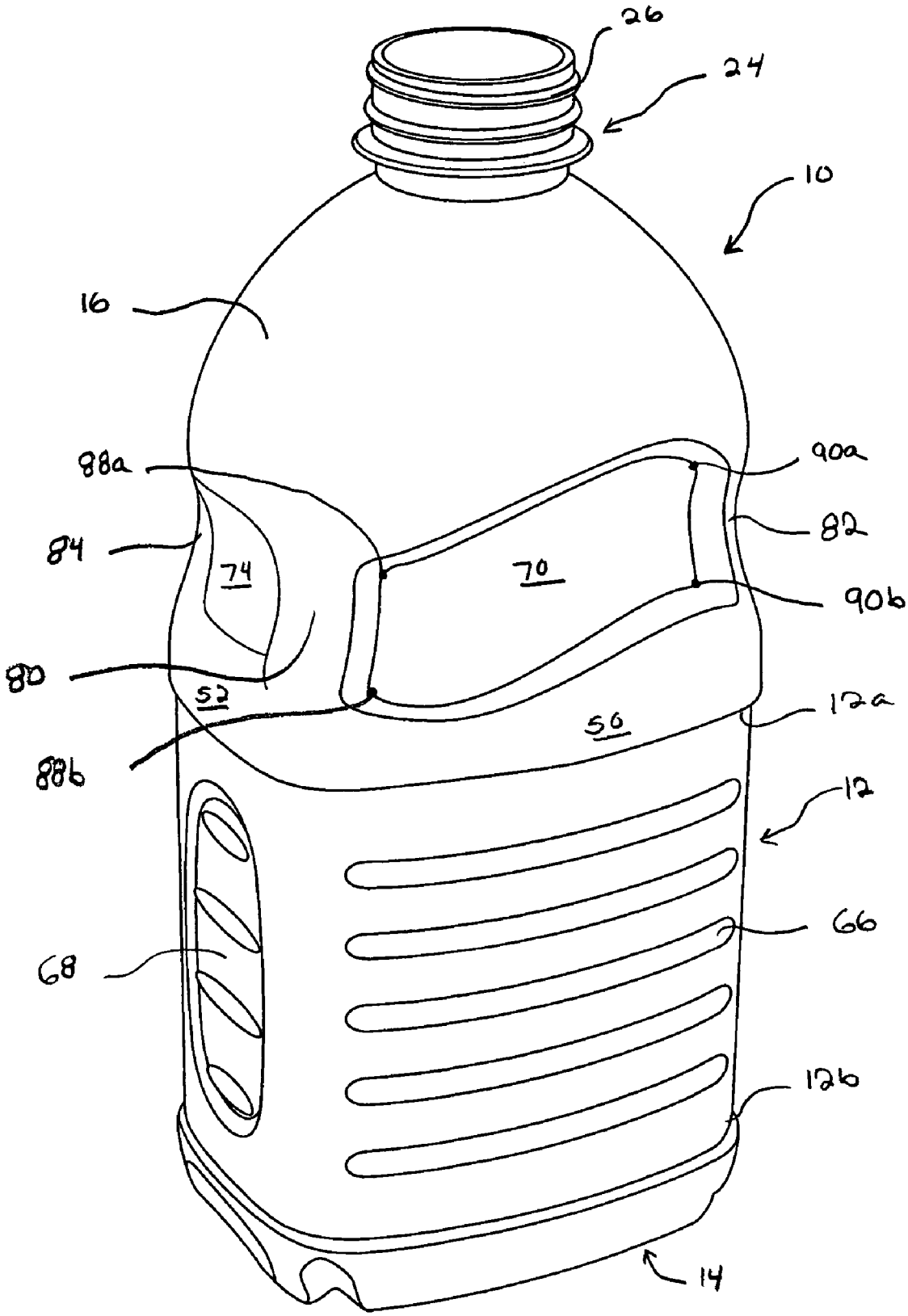
FIG. 1 is a perspective view of an exemplary embodiment of a plastic container according to the present invention.
Figure 2:
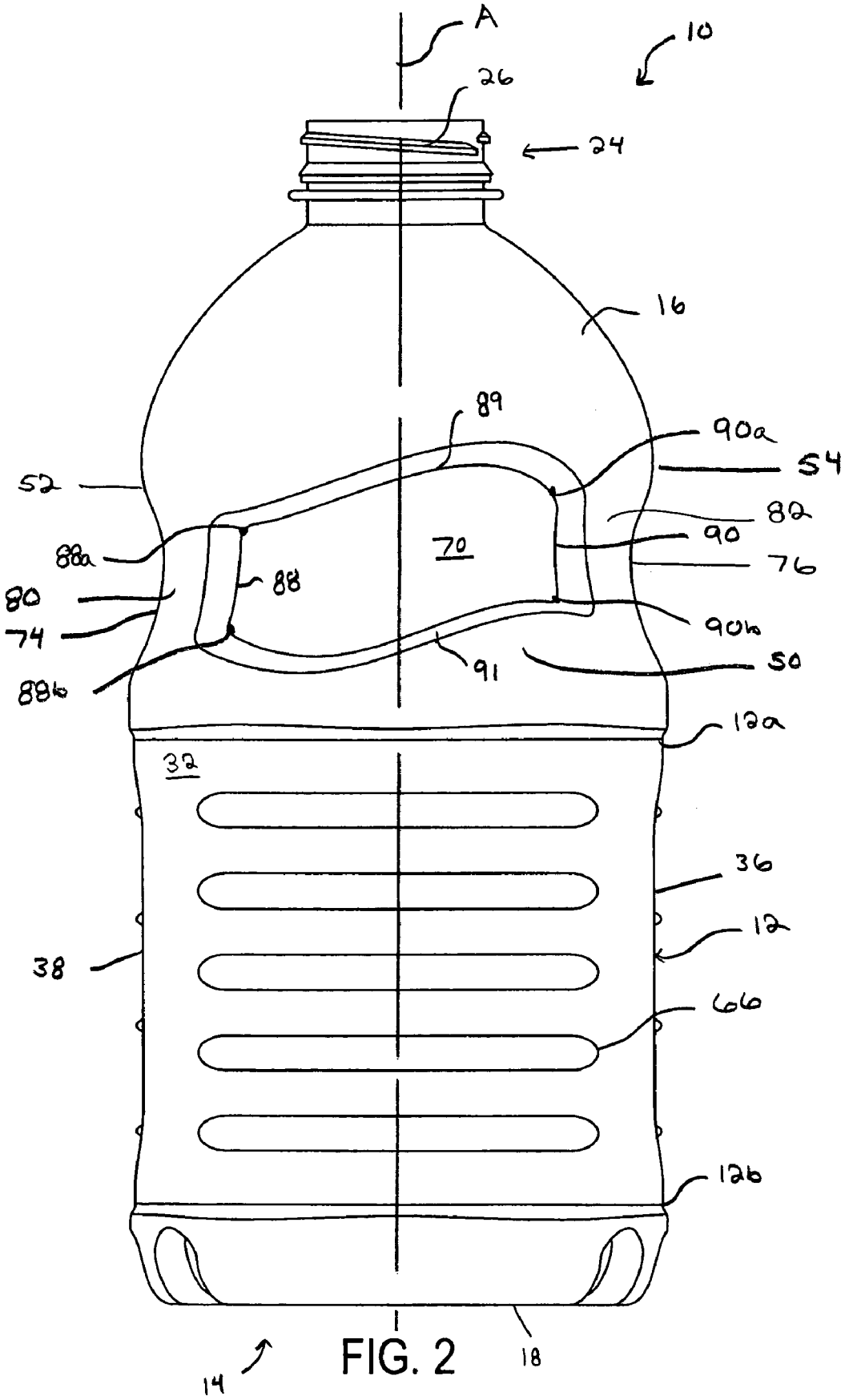
FIG. 2 is a front view of the container of FIG. 1.
Figure 3:
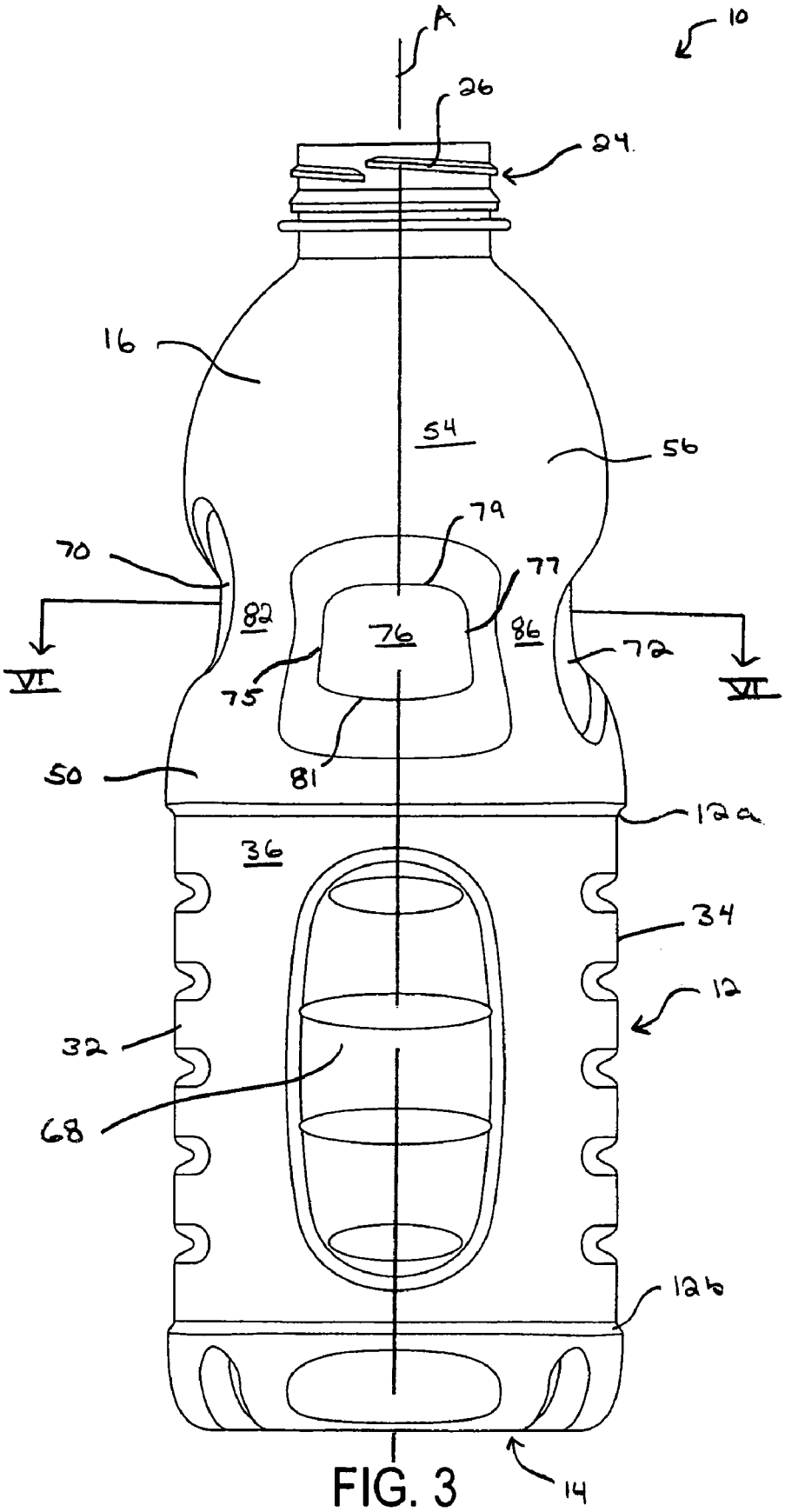
FIG. 3 is a side view of the container of FIG. 1.

Referring to FIGS. 1-3, the sidewall 12 can be seen. The sidewall 12 can be substantially tubular and can have any cross sectional shape. For example, the exemplary embodiment shown in FIGS. 2 and 3 has a substantially rectangular transverse cross-section defined by four sidewall portions 32, 34, 36, 38 joined by four rounded corner portions 40, 42, 44, 46 (FIG. 5). Alternative cross-sectional shapes can include, for example, a circular transverse cross-section, an oval transverse-cross section, a substantially square transverse cross-section, other substantially polygonal transverse cross-sectional shapes such as triangular, pentagonal, etc., and combinations of curved and arced shapes with linear shapes. As will be understood by one of ordinary skill in the art, when the container has a substantially polygonal transverse cross-sectional shape, the corners of the polygon are typically rounded or chamfered. A label, such as a thin film label (not shown), may be applied around the sidewall 12 for branding/labeling purposes.

Still referring to FIGS. 1-3, the sidewall 12 can include various rib structures 66, panels 68, and/or other structures known in the art, for example, to reinforce the sidewall 10 and/or to increase the performance of the container 10.

Figure 4:
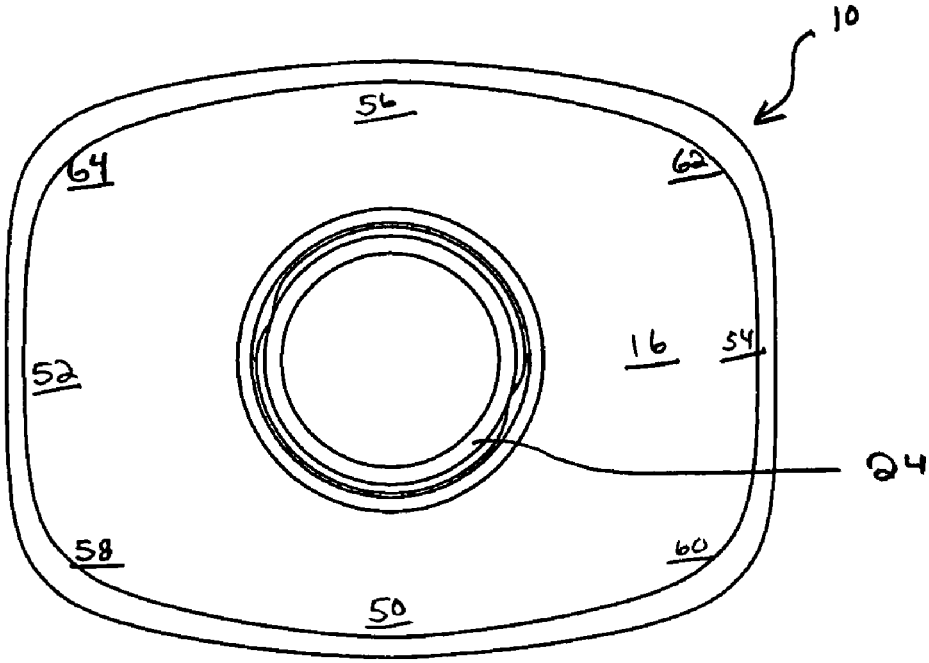
FIG. 4 is a top view of the container of FIG. 1.

In the exemplary embodiment shown in FIGS. 1-3, the dome 16 has a cross-sectional shape that compliments that of the sidewall 12. More specifically, the exemplary embodiment shown has wall-like portions 50, 52, 54, 56 joined by corner-like portions 58, 60, 62, 64 (FIG. 4). One of ordinary skill in the art will know, however, that other shapes and configurations of the dome 16 and/or sidewall 12 are possible.

Referring to FIGS. 1-3, and 6, the container 10 can include a plurality of recessed grip panels. The grip panels can be recessed deeply enough into the container 10 in order to provide secure, ergonomic gripping surfaces for the consumer's thumb and/or fingers. In the exemplary embodiment shown, the container 10 includes first and second primary grip panels 70, 72 recessed into the dome 16, as well as first and second secondary grip panels 74, 76 recessed into the dome 16. The primary grip panels 70, 72 can comprise the primary grip surface by which the consumer grabs and holds the container 10, while the secondary grip panels 74, 76 can comprise a secondary, or alternative, grip surface. For example, the primary grip panels 70, 72 can be larger than the secondary grip panels 74, 76. Additionally or alternatively, the primary grip panels 70, 72 can be located on the container 10 in a position more convenient for gripping than the secondary grip panels 74, 76.

The primary grip panels 70, 72 can be substantially opposed to one another about the container's longitudinal axis A. Additionally, or alternatively, the secondary grip panels 74, 76 can be substantially opposed to one another about the longitudinal axis A. In the exemplary container 10 having a substantially rectangular cross-section, the primary grip panels 70, 72 can be aligned with the larger, front and rear sidewall portions 32, 34, and the secondary grip panels 74, 76 can be aligned with the smaller, left and right sidewall portions 36, 38, however, other arrangements are possible. The primary and/or secondary grip panels can be concave with respect to the container's longitudinal axis A. This concavity can be seen with respect to grip panels 74 and 76 in FIG. 2 and with respect to grip panels 70 and 72 in FIG. 3. According to one exemplary embodiment, the secondary grip panels 74, 76 can have a tighter radius of curvature than the primary grip panels 70, 72, however, other configurations are possible. In addition, one of ordinary skill in the art will know that the grip panels are not limited to being concave. For example, the grip panels can alternatively be substantially flat panels surrounded by chamfered edges.

Referring to FIG. 2, the primary grip panels 70, 72 can be inclined with respect to the container's longitudinal axis A. For example, with reference to primary grip panel 70, the panel 70 can have left and right borders 88, 90, as well as upper and lower borders 89, 91. The right border 90 can have a higher elevation with respect to the longitudinal axis A than the left border 88, or vice versa. More specifically, the upper end 90*a* of the right border 90 can have a higher elevation than the upper end 88*a* of the left border 88. Similarly, the lower end 90*b* of the right border 90 can have a higher elevation than the lower end 88*b* of the left border 88. Additionally or alternatively, at least one of the upper and lower borders 89, 91 can be non-parallel to the base 14, for example, inclined with respect to the standing surface 18 of the base 14, as shown in FIG. 2.

In the exemplary embodiment shown, the upper and lower borders 89, 91 are curvilinear, however, they can alternatively be straight. Also, the upper and lower borders 89, 91 can be substantially parallel to one another, as shown, or alternatively, they can be non-parallel. The left and right borders 88, 90 can be substantially parallel to one another, as shown, or alternatively, non-parallel. The opposing primary grip panel 72 (not visible in FIG. 2) can have the same arrangement as grip panel 70, shown.

The secondary grip panels 74, 76 can each have left and right borders. For example, referring to FIG. 3, secondary grip panel 76 can have left border 75 and right border 77. The left and right borders 75, 77 can be substantially straight, as shown, or alternatively, curvilinear. The left and right borders 75, 77 can be substantially parallel or non-parallel. In addition, the secondary grip panels 74, 76 can each have upper and lower borders 79, 81, shown in FIG. 3.

The opposing, angled grip panels 70, 72 have been found to increase the gripability of the container 10. One of ordinary skill in the art will know, however, that the present invention is not limited to the shape and arrangement of the grip panels shown, and that other shapes and arrangements are possible. For example, the grip panels can alternatively be round, oval, square, or rectangular. In addition to serving as grip surfaces, the grip panels have been found to provide an attractive and convenient branding/labeling surface.

Referring to FIGS. 1-3, and 6, the container 10 can include a plurality of support columns. The support columns can comprise protruding columns defined by adjacent grip panels. In the exemplary embodiment shown, the container 10 includes four support columns 80, 82, 84, 86, although other arrangements are possible. The support columns 80, 82, 84, 86 can be substantially vertical (i.e., substantially parallel to the container's longitudinal axis A).

Figure 6:
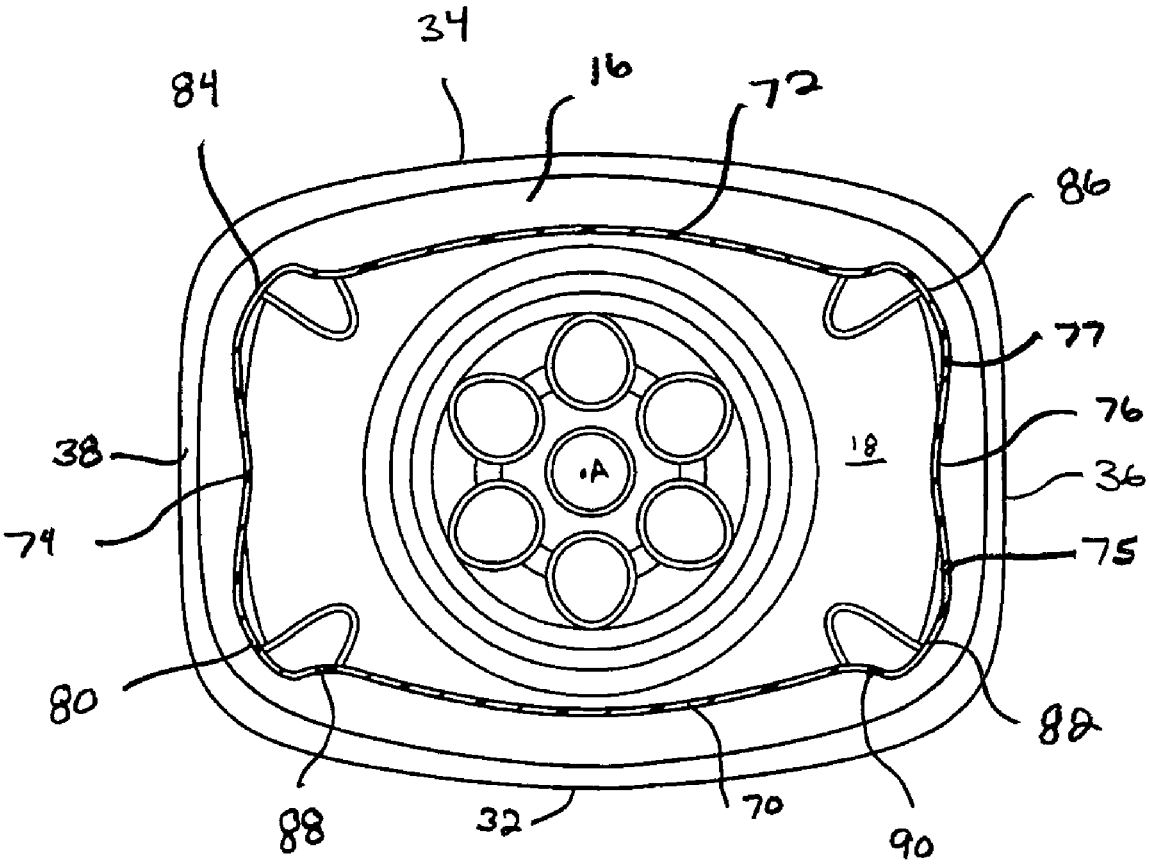
FIG. 6 is a cross-sectional view of the container of FIG. 1, taken along line VI-VI of FIG. 3.

Referring to the cross-sectional view of FIG. 6, each of the support columns comprises a relative protrusion located between two adjacent recessed grip panels. For example, support column 82 comprises an outwardly curved protrusion located on the dome 16 between adjacent primary grip panel 70 and secondary grip panel 76, both of which are recessed into the dome 16. The support columns can be defined by the adjacent grip panels, and more specifically, the borders of the grip panels. For example, as shown in FIG. 6, support column 82 can be defined between the left border 75 of secondary grip panel 76, and the right border 90 of primary panel 70. As discussed in more detail below with respect to the example, the support columns can increase the container's top load capacity (strength). The support columns can be substantially aligned with the corner-like portions 58, 60, 62, 64 of the dome 16, as shown in the figures, however, other arrangements are possible.

The container 10 can have a one-piece construction and can be prepared from a monolayer plastic material, such as a polyamide, for example, nylon; a polyolefin such as polyethylene, for example, low density polyethylene (LDPE) or high density polyethylene (HDPE), or polypropylene; a polyester, for example, polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example, to introduce oxygen barrier properties. In an exemplary embodiment, the present container is prepared from PET.

The container 10 can be made by conventional blow molding processes including, for example, extrusion blow molding, stretch blow molding, and injection blow molding.

EXAMPLE

Figure 7:
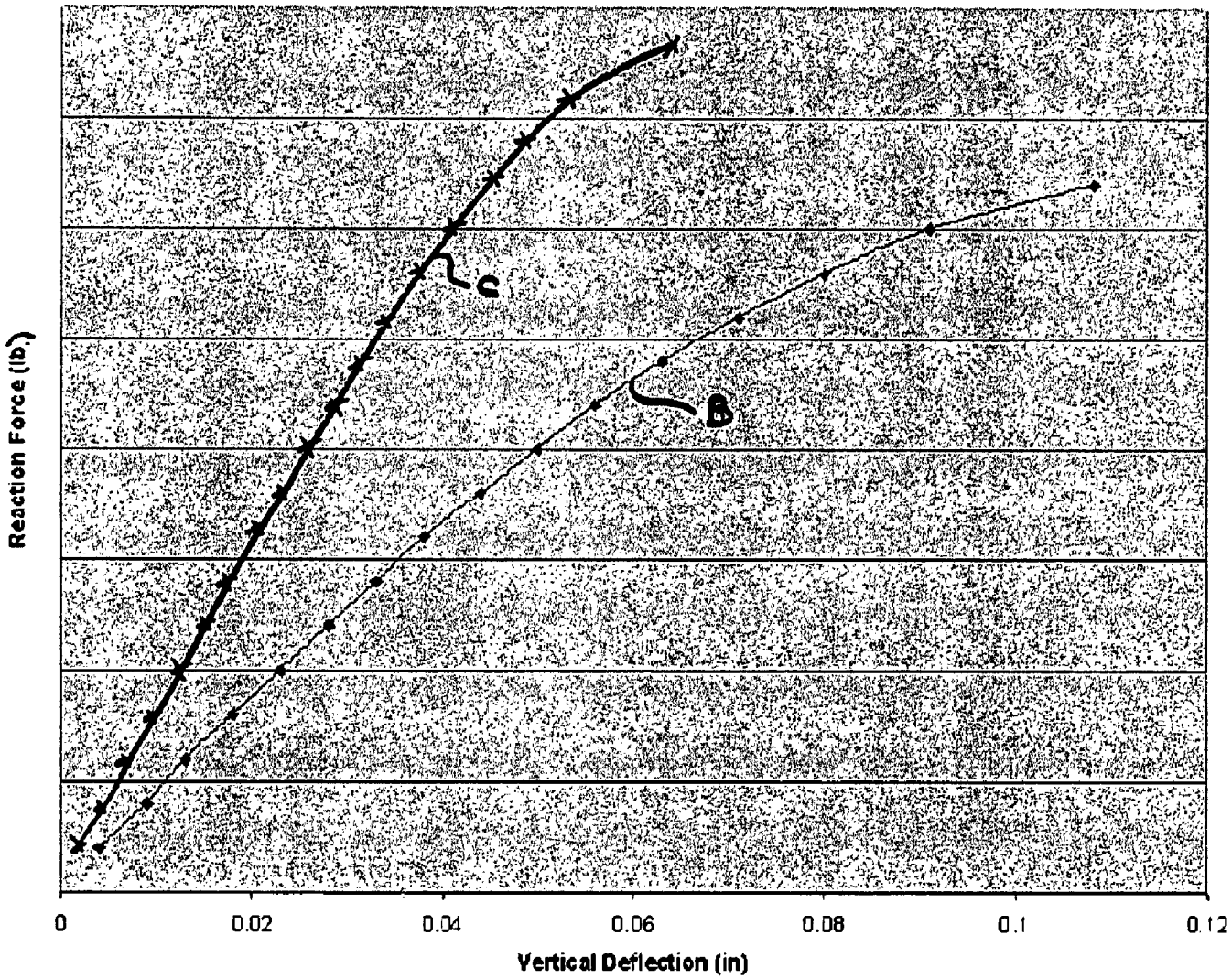
FIG. 7 is a chart comparing the top load characteristics of a plastic container according to the present invention with a conventional plastic container.

A model of a 64 oz container according to the present invention was compared to a model of a conventional 64 oz container using computerized Finite Element Analysis (FEA). The analysis used common and uniform wall thickness mapping for both models. The analysis was run using non-linear PET material properties for both models. FIG. 7 is a graph demonstrating the results of the analysis. The X-axis of the graph represents vertical deflection of the container (i.e., along its longitudinal axis) in inches. The Y-axis represents the amount of top load force applied to the container in pounds. Line B represents the force vs. deflection curve for the conventional container, and line C represents the force vs. deflection curve for the container according to the present invention. Based on the output of the FEA study, the 64 oz container according to the present invention demonstrated a top load capacity that is approximately 16% greater than that of the conventional 64 oz container.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A plastic container, comprising:

a sidewall including an upper end and a lower end; a base connected to the lower end of the sidewall;

a dome connected to the upper end of the sidewall, the dome including a finish portion adapted to receive a closure;

first and second primary grip panels recessed into the dome;

first and second secondary grip panels recessed into the dome; and a plurality of support columns located on the dome, with a support column located between each adjacent pair of primary and secondary grip panels;

wherein the first and second primary grip panels are larger than the first and second secondary grip panels.

2. The plastic container of claim 1, wherein each support column is defined by an adjacent pair of primary and secondary grip panels.

3. The plastic container of claim 1, wherein the first and second primary grip panels are substantially opposed from one another.

4. The plastic container of claim 3, wherein the first and second secondary grip panels are substantially opposed from one another.

5. The plastic container of claim 1, wherein the dome comprises wall portions connected by corner portions, with the grip panels recessed into the wall portions, and the support columns located at the corner portions.

6. The plastic container of claim 5, wherein the sidewall has a substantially rectangular cross-section.

7. The plastic container of claim 1, wherein the container defines a longitudinal axis, and each of the primary grip panels is inclined with respect to the longitudinal axis.

8. The plastic container of claim 7, wherein each primary grip panel includes opposite left and right borders, with one of the borders at a higher elevation with respect to the longitudinal axis than the other of the borders.

9. The plastic container of claim 7, wherein each primary grip panel includes opposite upper and lower borders, and at least one of the upper and lower borders is non-parallel to the base.

10. The plastic container of claim 1, wherein the container defines a longitudinal axis, and at least one of the grip panels is substantially concave with respect to the longitudinal axis.

11. The plastic container of claim 1, wherein the support columns increase the container's top load capacity.

12. A plastic container, comprising:

a sidewall comprising four sidewall portions and four corner portions defining a substantially rectangular cross-section, the sidewall including an upper end and a lower end;

a base connected to the lower end of the sidewall;

a dome connected to the upper end of the sidewall, the dome including a finish portion adapted to receive a closure;

first and second substantially opposed grip panels recessed into the dome;

third and fourth substantially opposed grip panels recessed into the dome; and a plurality of support columns located on the dome, with a support column located between each adjacent pair of grip panels;

wherein the first and second grip panels are larger than the third and fourth grip panels.

13. The plastic container of claim 12, wherein each support column is defined by an adjacent pair of the grip panels.

14. The plastic container of claim 12, wherein each of the grip panels is substantially aligned with one of the sidewall portions, and each of the support columns is substantially aligned with one of the corner portions.

15. The plastic container of claim 12, wherein the container defines a longitudinal axis, and the first and second grip panels are inclined with respect to the longitudinal axis.

16. The plastic container of claim 15, wherein the first and second grip panels each include opposite left and right borders, with one of the borders at a higher elevation with respect to the longitudinal axis than the other of the borders.

17. The plastic container of claim 15, wherein the first and second grip panels each include opposite upper and lower borders, and at least one of the upper and lower borders is non-parallel to the base.

18. The plastic container of claim 12, wherein the container defines a longitudinal axis, and the third and fourth grip panels are substantially concave with respect to the longitudinal axis.

19. The plastic container of claim 12, wherein the support columns increase the container's top load capacity.

* * * * *

UNITED STATES PATENT AND TRADEMARK OFFICE

CERTIFICATE OF CORRECTION

PATENT NO. : 7,631,775 B2
APPLICATION NO. : 11/411914
DATED : December 15, 2009
INVENTOR(S) : Heisner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 548 days.

Signed and Sealed this

Second Day of November, 2010

David J. Kappos

David J. Kappos
*Director of the United States Patent and Trademark Office*